US007906263B2

(12) United States Patent
Nakatani et al.

(10) Patent No.: US 7,906,263 B2
(45) Date of Patent: Mar. 15, 2011

(54) COLOR TONER FOR DEVELOPING ELECTROSTATIC LATENT IMAGE

(75) Inventors: Hiroshi Nakatani, Tokyo (JP); Toshihiko Yamato, Tokyo (JP); Hiroto Kidokoro, Tokyo (JP)

(73) Assignee: Zeon Corporation, Tokyo (JP)

( * ) Notice: Subject to any disclaimer, the term of this patent is extended or adjusted under 35 U.S.C. 154(b) by 939 days.

(21) Appl. No.: 10/593,396

(22) PCT Filed: Mar. 14, 2005

(86) PCT No.: PCT/JP2005/004453

§ 371 (c)(1), (2), (4) Date: Jun. 18, 2007

(87) PCT Pub. No.: WO2005/091080

PCT Pub. Date: Sep. 29, 2005

(65) Prior Publication Data

US 2008/0044752 A1 Feb. 21, 2008

(30) Foreign Application Priority Data

Mar. 23, 2004 (JP) ..... 2004-085076

(51) Int. Cl.
*G03G 9/00* (2006.01)

(52) U.S. Cl. ..... 430/108.23; 430/108.24; 430/111.4

(58) Field of Classification Search ..... 430/108.23, 430/108.24, 111.4

See application file for complete search history.

(56) References Cited

U.S. PATENT DOCUMENTS

2006/0172217 A1* 8/2006 Kidokoro ..... 430/110.3

FOREIGN PATENT DOCUMENTS

| | | | |
|---|---|---|---|
| JP | 7-175268 | | 7/1995 |
| JP | 11-015204 | A | 1/1999 |
| JP | 11-344829 | | 12/1999 |
| JP | 2000-56516 | A | 2/2000 |
| JP | 2001-117272 | A | 4/2001 |
| JP | 2001-242659 | A | 9/2001 |
| JP | 2002-108011 | | 4/2002 |
| JP | 2002-108013 | A | 4/2002 |
| JP | 2002-212142 | A | 7/2002 |
| JP | 2003-66731 | | 3/2003 |
| JP | 2003-131428 | | 5/2003 |
| JP | 2003-207949 | A | 7/2003 |
| JP | 2003-215848 | A | 7/2003 |
| JP | 2003-223018 | A | 8/2003 |
| JP | 2003-255613 | A | 9/2003 |
| JP | 2004-21126 | A | 1/2004 |
| JP | 2004-61686 | | 2/2004 |
| JP | 2005-62857 | | 3/2005 |

OTHER PUBLICATIONS

Sanyo Organic Pigments; Sanyo Color Works, Ltd.; Sanyo Color Series No. 244; pp. 3-14.

Japanese Notification of Reasons for Refusal, issued May 18, 2010 for corresponding Japanese Patent Application No. 2006-511182.

* cited by examiner

*Primary Examiner* — Mark A Chapman

(74) *Attorney, Agent, or Firm* — Westerman, Hattori, Daniels & Adrian, LLP

(57) ABSTRACT

The color toner for developing electrostatic latent images comprising a colored resin particle containing at least a binder resin, a colorant, a charge control agent and a parting agent, wherein an extracted liquid with water by means of a hot water extraction method from said colorant has a pH value in the range from 6.0 to 8.0, said colored resin particle has a volume average particle diameter (Dv) in the range from 4 to 10 μm and an average circularity in the range from 0.93 to 0.995, an amount of extracted components with methanol is 7% by weight or less, and an amount of residual volatile compounds is 500 ppm or less. The color toner for developing electrostatic latent images has excellent image-reproducibility and environmental durability and can form an image with a stable image density under a high temperature and high humidity condition.

11 Claims, No Drawings

COLOR TONER FOR DEVELOPING ELECTROSTATIC LATENT IMAGE

TECHNICAL FIELD

The present invention relates to a color toner for developing electrostatic latent images, and in particular, to a color toner for developing electrostatic latent images, which has excellent image-reproducibility and environmental durability and can form images with a stable image density under a high temperature and high humidity environment.

BACKGROUND ART

In an electrophotographic technology, an electrostatic latent image is formed on a photoconductive member made of a photoconductive material by various methods, the electrostatic latent image is developed with a toner for forming a visible image, and then after transferring the visible toner image onto a transfer medium such as paper or OHP film, the transferred toner image is fixed to the transfer medium by any of various methods such as heating and pressing thereby to obtain a print.

Conventionally, a toner requires excellent image-reproducibility (thin lines and fine points can be accurately reproduced at developing), low-temperature fixability, hot-offset resistance (a printed paper is not soiled by toner which remain on a hot pressing fixing roller) and the like.

Today, from an environmental viewpoint, it is required to reduce remaining volatile organic compounds (VOC) in the toners. On the other hand, an image forming apparatus using toners tends to be used under high temperature and high humidity areas. Accordingly, it is required for the toners to have excellent shelf stability and durability and also to form images with a stable image density even under such environment.

Conventionally, a pulverized toner has been mainly employed. The pulverized toner is produced in such a manner that a thermoplastic resin including a colorant, a parting agent, a charge control agent and the like is melt-blended to be uniformly dispersed, the dispersion is pulverized into fine particles by a pulverizing mill, and then the fine pulverized particles are classified by a classification apparatus.

However, in the pulverized toner produced by the aforesaid pulverization method, since the parting agent and the charge control resin dispersed in the binder resin are exposed on the surface of the toner, the melted toner is easily adhered to a surface of a high-temperature pressing roll. In other words, hot-offset easily occurs. In addition, the pulverized toner has a problem in decreasing of shelf stability and environmental durability. Besides, in a toner produced by a pulverization method, because of its irregular shape, a charge amount of the toner easily fluctuated, resulting in deteriorating image-reproducibility.

Especially, a color toner includes organic pigment as a colorant. The organic pigment is easily charged and therefore is sensitive to environmental condition, so that a charge amount of the toner may easily vary. In a full color image forming method, four color toners are overprinted for forming an image. So, if only one kind of the toners may have an unstable charge amount, an image cannot be reproduced correctly. Accordingly, a toner which is not subject to by environmental conditions, particularly a toner which has a stable charge amount under a high temperature and high humidity condition, has been required.

In order to achieve such requirement, a toner producing method by various types of polymerization methods including a suspension polymerization method has been proposed. For instance, in the suspension polymerization method, a polymerizable monomer, a colorant and a polymerization initiator, and, if necessary, a crosslinkable agent, a charge control agent and other additives are uniformly melt or dispersed to form a monomer composition and then the monomer composition is polymerized to obtain a toner particle having a desired particle diameter. By producing a toner by the polymerization method, the toner has a relatively narrow particle diameter distribution and contains a parting agent and a charge control agent enveloped within a particle, whereby a toner having a stable charge amount even under a high temperature and high humidity condition will be obtained.

As an exemplary polymerization toner, a toner for developing electrostatic latent images, which comprises a particle containing at least a binder resin, a colorant and a wax, is disclosed in Patent Literature 1. The toner disclosed in the literature has a number average particle diameter in the range from 2 to 6 μm, an average circularity in the range from 0.97 to 0.995 and an amount of residual monomer of 500 ppm or less. And, observation of the cross section of the toner using a transmission electron microscope (TEM) shows that the wax components are dispersed in the binder resin in islet form. The literature demonstrates that the toner has excellent dot-reproducibility (image-reproducibility) and can form a high-quality image for a long period. However, the toner has problems such as frequent occurrence of hot-offset and low environmental durability.

Beside, Patent Literature 2 disclose a producing method of a toner, in which 100 parts by weight of a charge control resin, 10 to 200 parts by weight of a colorant and 1 to 60 parts by weight of inorganic particles are mixed to prepare a charge control resin compound, the charge control resin compound is melted or dispersed into a polymerizable monomer to obtain a polymerizable monomer compound, and then the polymerizable monomer compound is polymerized in an aqueous dispersion medium. The toner produced according to the literature has excellent spectral property, such as translucency, necessary for reproducing a color tone of a color image clearly. And, by using the toner, an image can be formed with a high image density without generating fog. However, the toner requires improving stability of an image density under a high temperature and high humidity condition.

Published Patent literature 1: Japanese Patent Application Laid-open Hei 11-344829, Published Patent literature 2: Japanese Patent Application Laid-open 2003-131428.

DISCLOSURE OF THE INVENTION

Problems to be Resolved by the Invention

Accordingly, the object of the present invention is to provide a color toner for developing electrostatic latent image, which has excellent image-reproducibility and environmental durability and can form an image with a stable image density under a high temperature and high humidity condition.

The inventor of the present invention carried out an in-depth study to accomplish the object. As a result, he has found this object can be accomplished by using a color toner for developing electrostatic latent images comprising a colored resin particle containing at least a binder resin, a colorant, a charge control agent and a parting agent, in which the colorant is specified, the colored resin particle has a volume average particle diameter in the specified range and an average circularity in the specified range, an amount range of extracted liquid with methanol from the toner is specified and an amount range of residual volatile compound is specified.

The present invention has been accomplished based on the above finding and provide a color toner for developing electrostatic latent images comprising a colored resin particle containing at least a binder resin, a colorant, a charge control agent and a parting agent, wherein an extracted liquid with water from said colorant by means of a hot liquid extraction method has a pH value in the range from 6.0 to 8.0, said colored resin particle has a volume average particle diameter (Dv) in the range from 4 to 10 μm and an average circularity in the range from 0.93 to 0.995, an amount of an extracted liquid with methanol from said colored resin particle is 7 wt % or less, and an amount of a residual volatile compound in said colored resin particle is 500 ppm or less.

Effect of the Invention

According to the present invention, a color toner for developing electrostatic latent images, which has excellent image-reproducibility and environmental durability and can form an image with a stable image density under a high temperature and high humidity condition, can be provided.

BEST MODE FOR CARRYING OUT THE INVENTION

A color toner for developing electrostatic latent images according to the present invention is described in detail below.

A color toner for developing electrostatic latent images according to the present invention comprises a colored resin particle containing at least a binder resin, a colorant, a charge control resin and a parting agent.

As the examples of the binder resin, there can be mentioned; resins such as polystyrene, styrene-butyl acrylate copolymers, polyester resins and epoxy resins, which are conventionally used for the toner.

The examples of the colorant used in the present invention will be described below; however, ones, in which an extracted liquid with water by means of a hot water extraction method has a pH value in the range from 6.0 to 8.0, are employed. Preferably, the extracted liquid with water by means of a hot water extraction method has a pH value in the range from 6.5 to 8.0. When the extracted liquid with water by means of a hot water extraction method is out of the above range, the resultant toner may form an image with a low image density and have less environmental durability. And, fog may be generated on the image.

The pH value of the extracted liquid with water by means of a hot water extraction method from the colorant can be measured according to the following manner.

To a colorant weighed 5 g, 10 ml of ethanol and 10 ml of water are added and blended, and further 180 ml of ion-exchanged water having an electric conductivity of 1 μS/cm and a pH value of 7.0 is added. After stirring the mixture sufficiently, the mixture is boiled for 5 minutes, and a water-soluble component is extracted from the colorant to obtain an extracted liquid. The obtained extracted liquid is cooled down to room temperature and then another ion-exchanged water which has been boiled and then cooled down to the room temperature is added to the extracted liquid so that a total amount of the extracted liquid is 200 ml. The extracted liquid is sufficiently stirred and then filtered with a filter paper. Then, the filtrate is measured for a pH value.

The present invention refers to three color toners of a yellow color toner, a magenta color toner and a cyan color toner (referred to as a color toner collectively), and for each of the color toner, a yellow colorant, a magenta colorant and a cyan colorant are generally used.

As the yellow colorant, there can be mentioned; compounds such as azo pigments, and condensed polycyclic pigments. Specific examples of the yellow colorant include pigments such as C.I. Pigment Yellow 3, 12, 13, 14, 15, 17, 62, 65, 73, 74, 83, 90, 93, 97, 120, 138, 155, 180, 181, 185 and 186. One or two or more kinds of the colorant may be employed.

In the present invention, of the above yellow colorants, C.I. Pigment Yellow 74 is preferably employed. Furthermore, of the C.I. Pigment Yellow 74, ones in which an extracted liquid with water by means of a hot water extraction method has an electric conductivity in the range from 10 to 130 μS/cm, preferably 10 to 120 μS/cm, are preferred. By using C.I. Pigment Yellow 74 in which an extracted liquid with water by means of a hot water extraction method has an electric conductivity in the aforesaid range, a toner capable of forming an image with a high image density can be provided and aggregation of the colored resin particle can be suppressed.

As the magenta colorant, there can be mentioned; compounds such as azo pigments, and condensed polycyclic pigments. Specific examples of the magenta colorant include pigments such as C.I. Pigment Red 31, 48, 57, 58, 60, 63, 64, 68, 81, 83, 87, 88, 89, 90, 112, 114, 122, 123, 144, 146, 149, 150, 163, 170, 184, 185, 187, 202, 206, 207, 209, 251, and C.I. Pigment Violet 19. One or two or more kinds of the colorant may be employed.

Of the above magenta colorants, mixtures of C.I. Pigment Red 31 and C.I. Pigment Red 150 are preferably employed in the present invention. Especially, a solid solution of the mixture is more preferably employed. An amount ratio of C.I. Pigment Red 31 to C.I. Pigment Red 150 is generally 30:70 to 80:20, preferably 40:60 to 70:30, most preferably 50:50 to 60:40. Furthermore, of the mixtures of C.I. Pigment Red 31 and C.I. Pigment Red 150, ones in which an extracted liquid with water by means of a hot water extraction method has an electric conductivity in the range from 10 to 100 μS/cm, preferably 10 to 90 μS/cm, are preferably employed. By using the mixture of C.I. Pigment Red 31 and C.I. Pigment Red 150 in which an extracted liquid with water by means of a hot water extraction method has an electric conductivity in the aforesaid range, a toner capable of forming an image with a high image density can be provided and aggregation of the colored resin particle can be suppressed.

As the cyan colorant, there can be mentioned; cupper phthalocyanine compounds and their derivatives, anthraquinone compounds and the like. Specific examples of the cyan colorant include pigments such as C.I. Pigment Blue 2, 3, 6, 15, 15:1, 15:2, 15:3, 15:4, 16, 17, and 60. One or two or more kinds of the colorant may be employed.

Of the above cyan colorants, C.I. Pigment Blue, 15:3 or C.I. Pigment Blue 15:4 is preferably employed in the present invention. Furthermore, of C.I. Pigment Blue 15:3 and C.I. Pigment Blue 15:4, ones in which an extracted liquid with water by means of a hot water extraction method has an electric conductivity in the range from 10 to 40 μS/cm, preferably 10 to 35 μS/cm, is preferred. By using C.I. Pigment Blue 15:3 or C.I. Pigment Blue 15:4 in which an extracted liquid with water by means of a hot water extraction method has an electric conductivity in the aforesaid range, a toner capable of forming an image with a high image density can be provided and aggregation of the colored resin particle can be suppressed.

An electric conductivity of an extracted liquid with water by means of a hot water extraction method from the colorant is measured by using a filtrate prepared to measure for a pH value of an extracted liquid with water by means of a hot water extraction method from the colorant.

A colorant used in the present invention can be obtained in such a way that a colorant, in which an extracted liquid with water by means of a hot water extraction method has a pH value in the aforesaid range or an electric conductivity in the aforesaid range, is selected from commercially available colorants or a colorant produced in accordance with a commonly known producing method is subjected to after treatments such as washing sufficiently.

As the charge control agent, charge control agents used in conventionally used toners can be employed without limitation. Among the charge control agents, a charge control resin is preferable, because charge control resins have high compatibility with binder resins, are colorless, and can provide a toner with a stable charging property even when it is used in high-speed continuous color printing. As the positive charge control resin, there can be mentioned; quaternary ammonium (salt) group-containing copolymers produced in accordance with the descriptions of U.S. Pat. No. 4,840,863(A), Japanese Patent Application Laid-Open Nos. Hei 3-175456, Hei 3-243954 and Hei 11-15192. And, as the negative charge control resin, there can be mentioned; sulfonic acid (salt) group-containing copolymers produced in accordance with the descriptions of U.S. Pat. No. 4,950,575(A) and Japanese Patent Application Laid-Open No. Hei 3-15858.

An amount of the monomer unit having the quaternary ammonium (salt) group or the sulfonic acid (salt) group contained in these copolymers is preferably 1 to 12% by weight, more preferably 2 to 10% by weight, per an amount of the charge control resin. If the amount of the monomer unit may be within this range, a charge amount of the toner for developing electrostatic latent images is easy to control, and the generation of fog in printed image developed using the toner can be minimized.

Preferred as the charge control resin is that having a weight average molecular weight of 2,000 to 50,000, more preferably 4,000 to 40,000, most preferably 6,000 to 35,000. If the charge control agent may have a weight average molecular weight within the aforesaid range, occurrence of hot-offset and deteriorating of fixability may be suppressed.

A glass transition temperature of the charge control resin is preferably from 40 to 80° C., more preferably from 45 to 75° C., most preferably from 45 to 70° C. If the glass transition temperature of the charge control resin may be within this range, shelf stability and fixability may be improved in a balanced manner.

An amount of the above charge control agent is generally 0.1 to 10 parts by weight, preferably 0.1 to 6 parts, per 100 parts by weight of the binder resin.

As the parting agent, there can be mentioned; polyolefin waxes such as low molecular weight polyethylene, low molecular weight polypropylene and low molecular weight polybutylene; natural plant waxes such as candelilla, carnauba, rice, wood wax and jojoba; petroleum waxes such as paraffin, microcrystalline and petrolatum, as well as waxes modified therefrom; synthetic waxes such as Fischer-Tropsch wax; and multifunctional ester compounds such as pentaerythritol tetrastearate, pentaerythritol tetrapalmitate, dipentaerythritol hexamyristate and pentaerythritol tetramyristate.

Among these parting agents, multifunctional ester compounds are preferred. Furthermore, multifunctional ester compounds are more preferred, which show an endothermic peak temperature within the range preferably from 30 to 150° C., more preferably from 40 to 100° C., most preferably from 50 to 80° C., measured with a DSC curve by means of a differential scanning calorimeter at rising temperature, because a toner excellent in a balance between fixing property and peeling property during fixing is obtained. In particular, those having a molecular weight of 1,000 or more and soluble in styrene at 25° C. in amount of 5 parts by weight or more based on 100 parts by weight of styrene, and having an acid value of 1 mgKOH/g or less and a hydroxy value of 0.1 to 4 mg KOH/g or less, are even more preferred, because it exhibits an effect in lowering a minimum fixing temperature and suppressing occurrence of hot-offset. Especially, as such the multifunctional ester compounds, dipentaerythritol hexamyristate and pentaerythritol tetramyristate are preferred. The acid value and the hydroxyl value refer to values measured in accordance with JOCS.2.3.1-96 and JOCS.2.3.6.2-96, respectively, which are standards of an oil analysis method established by JAPAN Oil Chemists' Society (JOCS). The endothermic peak temperature refers to values measured in accordance with ASTM D3418-82.

An amount of the parting agent is generally 1 to 20 parts by weight, preferably 3 to 15 parts by weight, per 100 parts by weight of the binder resin.

And, when an addition amount of the parting agent per 100 parts by weight of the binder resin is set to "b" and a hydroxy value (mgKOH/g) of the parting agent is set to "a", a product (a×b) of "a" and "b" is preferably 0.5 to 40, more preferably 2 to 30. When a product of "a" and "b" may be set to the aforesaid range, occurrence of fog on a printed image formed by the resultant toner can be suppressed.

The colored resin particle may be a so-called core-shell structured (also called "capsule type") particle, in which a polymer for an inner layer (an core layer) of the particle is different from a binder resin for an outer layer (a shell layer) of the particle. The core-shell structure is preferred because the type can provide a favorable balance between lowering of the fixing temperature and prevention of aggregation of the toner during storage by covering the low softening point substance as the inner layer (core layer) with a substance having a higher softening point.

The core layer of the core-shell type particle is composed of the aforementioned binder resin, colorant, charge control resin and parting agent, while the shell layer is composed of the binder resin alone.

A proportion by weight of the core layer to the shell layer of the core-shell type particle is not particularly limited, but is generally in the range from 80/20 to 99.9/0.1.

By using the shell layer in this proportion, good shelf stability and good low temperature fixability of the toner can be fulfilled at the same time.

An average thickness of the shell layer of the core-shell type particle may be generally 0.001 to 0.1 μm, preferably 0.003 to 0.08 μm, more preferably 0.005 to 0.05 μm. The toner having a thickness within the range is preferred because fixability and storage ability thereof are improved. The colored resin particle of the core-shell type particle does not necessarily have entire of its surface covered with the shell layer. The surface of the core particle may partly be covered with the shell layer.

A diameter of the core particle and a thickness of the shell layer of the core-shell type particle can be measured by directly measuring the diameter and thickness of particles which are chosen randomly from photographs taken with an electron microscope, if possible. When it is difficult to observe both of the core and shell layer by an electron microscope, they can be calculated based on the diameter of the core particle and the amount of the monomer used for forming the shell layer at the time of producing the toner.

The colored resin particle constituting a color toner for developing electrostatic latent images according to the present invention has preferably a volume average particle diameter (Dv) in the range from 4 to 10 μm, more preferably 5 to 10 μm. If the Dv may be smaller than the range, flowability of the resulting color toner for developing electrostatic latent images may be lowered and an image density of a printed image formed by the resultant color toner may be lowered. On the contrary, if the Dv may be larger than the range, image-reproducibility may deteriorate.

The colored resin particle constituting a color toner for developing electrostatic latent images according to the present invention preferably has a ratio (Dv/Dp) of the volume average particle diameter (Dv) to a number average particle diameter (Dp) in the range from 1.0 to 1.3, preferably 1.0 to 1.2. If the Dv/Dp may be within this range, occurrence of fog on a printed image formed by the resultant toner may be suppressed.

The colored resin particle constituting a color toner for developing electrostatic latent images according to the present invention has an average circularity in the range from 0.93 to 0.995, preferably 0.95 to 0.995, wherein the average circularity is measured by means of a flow particle image analyzer. If the average circularity may be smaller than 0.93, image-reproducibility and fixability may deteriorate.

Producing a color toner for developing electrostatic latent images by means of a phase-transfer emulsion process, a solution suspension process, or a polymerization process (suspension polymerization process, emulsion polymerization method) and the like makes it possible to set the average circularity within the range easily.

In the present invention, the circularity is defined as a ratio of a perimeter of a circle having the same projected area as that of the particle image to a perimeter of the projected area of the particle. And, an average circularity in the present invention is used as a conventional method for quantitatively presenting a shape of a particle, and is an index for showing a degree of surface roughness of the colored resin particle. If the colored resin particles are perfectly spherical, the average circularity equals to 1. And, the larger the roughness of the colored resin particle is, the smaller the average circularity is. The average circularity (Ca) is calculated using the following formula.

$$Ca = \left(\sum_{i=1}^{n} (Ci \times fi)\right) \Big/ \sum_{i=1}^{n} (fi)$$

In the above formula, n represents the number of particles used for calculating the circularity Ci.

In the above formula, Ci represents the circularity of each particle in a group of particles having a circle equivalent diameter of 0.6 to 400 μm, which is calculated by the following formula from the measured circuit length of each particle.

Circularity (Ci)=a perimeter length of the circle having the same area with the projected area of a particle/a perimeter length of the projected area of the particle.

In the above formula, $f_1$ represent a frequency of particle having circularity $C_1$.

The number average particle diameter, the volume average particle diameter, the circularity and the average circularity of the colored resin particle may be measured with flow type particle image analyzers, such as FPIA-1000 (trade name) or FPIA-2000 (trade name), manufactured by Sysmex Corporation.

In the color toner for developing electrostatic latent images according to the present invention, an amount of an extracted component with methanol is preferably 7% by weight or less, more preferably 5% by weight or less. If the amount of an extracted component with methanol may exceed 7% by weight, an image density of a printed image formed by the resultant toner may be lowered, environmental durability of the toner may decrease and fog may be generated on the printed image. An amount of an extracted liquid with methanol can be measured by the after-mentioned method.

In the color toner for developing electrostatic latent images according to the present invention, an amount of residual volatile compounds is 500 ppm or lower, more preferably 300 ppm or lower. When the amount of residual volatile compounds may be within the aforesaid range, an image density of a printed image formed by the resultant toner may be heightened, environmental durability of the toner may be improved and fog generated on the printed image formed by the resultant toner may be suppressed.

As such residual volatile compounds, for instance, resin unreacted residual, monomer, residual reaction solvent, impurities in colorant, impurities in charge control resin, impurities in external additive and reaction product, decomposition product and oxide of polymerization initiator and chain transfer agent are given.

Heretofore, as to volatile compounds of a toner, an amount of residual monomers is provided; however, the toner may contain hard-volatile compounds and substances which are decomposed and volatilized at high temperatures, in addition to the residual monomers. Remaining of hard-volatile compounds and the like may exert bad influence on a printed image quality well as fixability. Generally, a monomer component has a volatilization temperature of 130° C. or lower while a fixing roll is generally heated 180 to 200° C. during fixing a toner. Accordingly, it is necessary to reduce an amount of residuals of a polymerization initiator and a molecular weight modifier, which have a higher volatilization temperature than the temperature of the fixing roll, in addition to the monomer components.

In the present invention, a volatile compound is determined in the following manner. For example, a color toner for developing electrostatic latent images is heated at 200° C. for 30 minutes and then a compound volatilized at the heating temperature is determined using a purge & trap (P&T)/gas chromatography. Usually, a volatile compound is determined using a headspace/gas chromatography; however, a P&T/gas chromatography method is preferred from a viewpoint of precision. However, various methods capable of determining a volatile compound, in addition to the above method, may be employed. A qualitative analysis of a volatile compound can be carried out using a mass spectroscopy/gas chromatography (MS/GC) and the like.

In the color toner for developing electrostatic latent images according to the present invention, an amount of insoluble component in tetrahydrofuran is preferably 30 to 95% by weight, more preferably 40 to 90% by weight. An amount of insoluble component in tetrahydrofuran within the range is preferred because occurrence of hot-offset may be suppressed and fixability of the toner may be improved.

An amount of insoluble component in tetrahydrofuran can be measured using an after-mentioned method.

For the color toner for developing electrostatic latent images according to the present invention, the toner can be used, as it is, for development in electrophotography. Generally, however, it is preferable that the toner is used after fine particles having a smaller particle diameter than that of the colored resin particles (the fine particles will be referred to hereinafter as an external additive) are adhered to or buried into the surfaces of the colored resin particles, in order to adjust the charging property, flowability and shelf stability of the toner.

Examples of the external additive are inorganic particles and organic resin particles which are used for improving flowability and charging property. The particles added as the external additive has an average particle diameter smaller than the colored resin particle. Specific examples of the inorganic particles include silica, aluminum oxide, titanium oxide, zinc oxide, tin oxide and the like. Specific examples of the organic resin particles include methacrylic ester polymer particles, acrylic ester polymer particles, styrene-methacrylic ester copolymer particles, styrene-acrylic ester copolymer particles, core-shell structured particles having a core formed of a styrene polymer and a shell formed of a methacrylic ester polymer. Of these particles, particles of silica and titanium oxide are preferred. In addition, hydrophobicitizing-treated particles are preferred. In fact, a hydrophobicitizing-treated silica is more preferred. An amount of the external additive is not limited; however, is generally 0.1 to 6 parts by weight per 100 parts by weight of the colored resin particle.

The colored resin particle constituting a color toner for developing electrostatic latent images according to the present invention may be produced by any methods for producing a toner having the aforesaid properties; however, not limited to, the colored resin particle is preferably produced by a polymerization method, especially a suspension polymerization method.

Next, a method for producing a colored resin particle constituting a color toner for developing electrostatic latent images by the polymerization method will be described.

The colored resin particle constituting a color toner for developing electrostatic latent images according to the present invention is produced, for instance, such that the aforesaid colorant, charge control agent and other additives are dissolved or dispersed in a polymerizable monomer (comprising monovinyl monomer, crosslinkable monomer and the like) which is a raw material of a binder resin, the dispersion is polymerized by adding a polymerization initiator in an aqueous dispersion medium containing a dispersion stabilizer and then the resultant product is subjected to a filtration, washing, dehydration and drying. At the polymerization, it is preferable to use a colorant in which an extracted liquid with water by means of a hot water extraction method has a pH value in the range from 6.0 to 8.0 because aggregate is hardly generated at the polymerization.

As a polymerizable monomer, there can be mentioned, for instance, a monovinyl monomer, if necessary, a crosslinkable monomer and a macromonomer. These polymerizable monomers become the binder resin component after polymerization.

Specific examples of the monovinyl monomers include; aromatic vinyl monomers such as styrene, vinyltoluene and α-methylstyrene; acrylic ester monomers such as acrylic acid, methyl acrylate, ethyl acrylate, propyl acrylate, butyl acrulate, 2-ethylhexyl acrylate, cyclohexyl acrylate and isobonyl acrylylate; methacrylic ester monomers such as methacrylic acid, methyl methacrylate, ethyl methacrylate, propyl methacrylate, butyl methacrylate, 2-ethylhexyl methacrylate, cyclohexyl methacrylate and isobonyl methacrylylate; and mono olefin monomers such as ethylene, propylene and butylenes; and the like.

The monovinyl monomers may be used alone or in a combination thereof. Among the monovinyl monomers as mentioned above, it is preferable to use aromatic vinyl monomers alone, or to use aromatic vinyl monomers in a combination with acrylic ester monomers or methacrylic ester monomers.

The use of the crosslinkable monomer in a combination with the monovinyl monomer effectively improves hot offset resistance of the resulting toner. The crosslinkable monomer is a monomer having two or more vinyl groups. As specific examples of the crosslinkable monomer, there can be mentioned; divinylbenzene, divinylnaphthalene, ethyleneglycol dimethacrylate, pentaerythritol triallyl ether and trimethylolpropane triacrylate. These crosslinkable monomers may be used alone or in a combination thereof. An amount of the crosslinkable monomer is generally 10 parts by weight or less, preferably 0.1 to 2 parts by weight, per 100 parts by weight of the monovinyl monomer.

It is preferable to use a macromonomer together with the monovinyl monomer because this use provides a satisfactory balance between shelf stability and fixability at a low temperature. The macromonomer is an oligomer or polymer having a polymerizable carbon-carbon unsaturated double bond at its molecular chain terminal and a number average molecular weight of generally from 1,000 to 30,000.

The macromonomer is preferably the one which gives a polymer having a glass transition temperature higher than that of a polymer obtained by polymerizing the above-mentioned monovinyl monomer alone.

An amount of the macromonomer used is generally 0.01 to 10 parts by weight, preferably 0.03 to 5 parts by weight, more preferably 0.05 to 1 part by weight, per 100 parts by weight of the monovinyl monomer.

As examples of the polymerization initiator, there can be mentioned; persulfates such as potassium persulfate and ammonium persulfate; azo compounds such as dimethyl 2,2'-azobis(2-methyl propionate), 4,4'-azobis-(4-cyanovaleric acid), 2,2'-azobis-(2-methyl-N-(2-hydroxyethyl))propionamide, 2,2'-azobis-(2-amidinopropane)dihydrochloride, 2,2'-azobis-(2,4-dimethyl valeronitrile) and 2,2'-azobis-isobutyronitrile; and peroxides such as di-t-butyl peroxide, benzoyl peroxide, t-butyl peroxy-2-ethylhexanoate, t-hexyl peroxy-2-ethylhexanoate, t-butyl peroxypivalate, di-isopropyl peroxydicarbonate, di-t-butyl peroxyisophthalate, and t-butyl peroxyisobutyrate. Redox initiators, composed of combinations of these polymerization initiators with a reducing agent, may also be used.

An amount of the polymerization initiator used in the polymerization of the polymerizable monomer is preferably 0.1 to 20 parts by weight, more preferably 0.3 to 15 parts by weight, most preferably 0.5 to 10 parts by weight, per 100 parts by weight of the polymerizable monomer. The polymerization initiator may be added to the polymerizable monomer composition in advance or may be added to an aqueous dispersion medium after forming droplets depending on conditions.

Moreover, at the time of polymerization, a dispersion stabilizer may be added to the aqueous dispersion medium. As the dispersion stabilizer, there can be mentioned; an inorganic salt such as barium sulfate, calcium sulfate, calcium carbonate, magnesium carbonate and calcium phosphate; an inorganic oxide such as aluminum oxide and titanium oxide; an inorganic compound such as aluminium hydroxide, magnesium hydroxide and ferric hydroxide; a water-soluble polymers such as polyvinyl alcohol, methyl cellulose and gelatin; anionic surfactants; nonionic surfactants; and amphoteric surfactants. The aforesaid dispersion stabilizers may be used alone or in combination of two kinds thereof.

Among the above dispersion stabilizers, in a suspension polymerization method, a dispersion stabilizer containing colloid of an inorganic compound, especially a hardly water-soluble inorganic hydroxide, is preferred, since it can narrow a particle size distribution of a polymer particles; a remaining amount of the dispersion stabilizer after washing is small; and it can sharply reproduce images.

An amount of the above dispersion stabilizer is preferably 0.1 to 20 parts by weight per 100 parts by weight of the polymerizable monomer. The amount of the dispersion stabilizer within this range is preferred because the polymerization reaction is stably performed and a formation of polymerization aggregate is suppressed.

Further, upon the polymerization, a molecular weight modifier is preferably used. As the molecular weight modifier, there can be mentioned; mercaptans such as t-dodecyl mercaptan, n-dodecyl mercaptan, n-octyl mercaptan and 2,2,4,6,6-pentamethylheptane-4-thiol and the like. Among the above ones, 2,2,4,6,6-pentamethylheptane-4-thiol is preferred. The above molecular weight modifier may be added before or during polymerization reaction. An amount of the molecular weight modifier is preferably 0.01 to 10 parts by weight, more preferably 0.1 to 5 parts by weight, per 100 parts by weight of the polymerizable monomer.

A method for producing the core-shell type colored resin particles is not limited, and these colored resin particles can be produced by a publicly known method. For example, a method such as spray-drying method, interfacial reaction method, in-situ polymerization method, or phase separation method may be named. Specifically, colored resin particles obtained by pulverization, polymerization, association or phase inversion emulsification as core particles are covered with a shell layer to prepare core-shell type colored resin particles. Of these methods, the in-situ polymerization method and phase-separation method are preferable from the viewpoint of efficient productivity.

The method for producing the core-shell type colored resin particles using the in-situ polymerization process is described below.

A polymerizable monomer to form a shell (a polymerizable monomer for shell) and a polymerization initiator are added to an aqueous dispersion medium including core particles dispersed therein, and the mixture is polymerized to obtain the core-shell type colored resin particles.

As specific examples of the process for forming the shell, there can be mentioned; a process comprising adding a polymerizable monomer for a shell to a reaction system of a polymerization reaction which has been conducted for preparing core particles to continuously conduct polymerization; and a process comprising introducing core particles prepared in a different reaction system and adding a polymerizable monomer for a shell thereto to conduct polymerization.

The polymerizable monomer for shell may be added to the reaction system at one time, or may be added continuously or dividedly using a pump such as a plunger pump.

As the polymerizable monomer for shell, monomers capable of forming a polymer having a glass transition temperature of higher than 80° C. by polymerization, such as styrene, acrylonitrile and methyl methacrylate, may be used alone or in a combination thereof.

When the polymerizable monomer for shell is added to the reaction system, a water-soluble polymerization initiator as a polymerization initiator for polymerizing the polymerizable monomer for shell is preferably added, because this addition makes it easy to obtain the core-shell type colored particles. It is speculated that when the water-soluble polymerization initiator is added during addition of the polymerizable monomer for shell, the water-soluble polymerization initiator migrates to a zone surrounding the surface of the core particle, the zone where the polymerizable monomer for shell has moved, so that a polymer (shell) is easily formable on the surface of the core particle.

As the water-soluble polymerization initiator; there can be mentioned; persulfates such as potassium persulfate, and ammonium persulfate; azo compounds such as 2,2'-azobis-(2-methyl-N-(2-hydroxyethyl)propionamide), and 2,2'-azobis-(2-methyl-N-(1,1'-bis(hydroxymethyl)-2-hydroxyethyl) propionamide. An amount of the water-soluble polymerization initiator is generally 0.1 to 30 parts by weight, preferably 1 to 20 parts by weight, per 100 parts by weight of the polymerizable monomer for shell.

A temperature during the polymerization is preferably 50° C. or higher, more preferably 60 to 95° C. A polymerization reaction period is preferably 1 to 20 hours, more preferably 2 to 10 hours. After completion of the polymerization, a procedure comprising filtration, washing, dehydration and drying is preferably repeated several times, as desired, in accordance with the conventional methods after removing residual volatile compounds.

In the aqueous dispersion of the colored resin particles obtained by the polymerization, if an inorganic compound such as inorganic hydroxide is used as the dispersion stabilizer, the dispersion stabilizer is preferably dissolved in water and removed by adding acid or alkali. If a colloid of a hardly water-soluble inorganic hydroxide is used as the dispersion stabilizer, it is preferable to add acid so that pH of the aqueous dispersion is pH 6.5 or lower. As the acid to be added, an inorganic acid such as sulfuric acid, hydrochloric acid or nitric acid; or an organic acid such as formic acid or acetic acid; can be used. Sulfuric acid is particularly preferable because it has a high efficiency of its removal and its burden on production facilities is light.

There is no limitation on the method of filtering the colored resin particle from the aqueous dispersion medium for dehydration. For example, centrifugal filtration, vacuum filtration or pressurized filtration can be named. Of these methods, centrifugal filtration is preferable.

The color toner for developing electrostatic latent images according to the present invention is obtained by mixing the colored resin particles and the external additive and, if desired, other fine particles by means of a high-speed stirrer such as a Henschel mixer.

Example

The present invention is hereinafter to be described more specifically by the following examples. Such examples, however, are not to be construed as limiting in any way the scope of the present invention. All designations of "part" or "parts" and "%" used in the following examples mean part or parts by weight and wt. % unless expressly noted.

(1) Volume Average Particle Diameter and Particle Diameter Distribution

A volume average particle diameter (Dv) and a particle diameter distribution, i.e., a ratio (Dv/Dp) of the volume average particle diameter to a number average particle diameter (Dp), of the toner was measured by means of a particle diameter measuring device ("MULTISIZER", trade name, manufactured by Beckman Coulter, Inc.). The measurement by the Multisizer was conducted under the following conditions:

Aperture diameter: 100 μm;
Medium: Isothone II;
Concentration: 10% and
Number of particles measured: 100,000 particles.

(2) Average Circularity

100 μl of an aqueous solution of 0.1% sodium dodecyl sulfonate (an anionic surfactant) as a dispersion medium was added to 20 mg of a color toner for developing electrostatic latent images and blended. And, 10 ml of ion-exchanged water was added to the toner solution and stirred, and then the toner solution was dispersed using an ultrasonic dispersion apparatus of 60 W for 30 minutes. A toner concentration at a measurement was adjusted to 3,000 to 10,000/μl, and then 1,000 to 10,000 of the toner particle having a circle equivalent diameter of 1 μm or more were evaluated using a flow particle image analyser "FPIA-2100" (trade name), manufactured by Sysmex Corporation. From the measurement, an average circularity was obtained.

(3) A pH Value and Electrical Conductivity of an Extracted Liquid with Hot Water from Colorant Colorant weighed 5 g was charged in a 300 ml beaker, and 10 ml of ethanol and 10 ml of water were charged in the beaker and blended with the colorant. And, 180 ml if ion-exchanged water having an electric conductivity of 1 μS/cm and a pH value of 7.0 was added to the colorant solution. Then, the colorant solution was sufficiently stirred and then boiled for 5 minutes to extract water-soluble component from the colorant thereby to obtain an extracted liquid. After cooling the obtained extracted liquid down to room temperature (about 25° C.), the extracted water was charged in a 200 ml measuring flask. And then, another ion-exchanged water, which had been boiled and then cooled down to room temperature (about 25° C.), was added to the measuring flask such that a total amount of the extracted water and the ion-exchanged water was 200 ml. After stirring the solution sufficiently, the solution was filtrated with a filter paper (No. 5C, Filter paper, manufactured by Toyo Roshi Kaisha, Ltd.). And, the filtrate was measured for a pH value using a pH meter ("D-14", trade name, manufactured by Horiba Ltd.) and for an electrical conductivity using a conductivity meter ("ES-12", trade name, manufactured by Horiba Ltd.).

(4) Amount of Extracted Liquid with Methanol

The color toner for developing electrostatic latent images weighed about 0.8 to 1.0 g was put in a cylindrical filter paper (No. 86R, manufactured by Toyo Roshi Kaisha, Ltd.) previously weighed, and the cylindrical filter paper was set on a Soxhlet extractor. Then, an extraction was performed for 6 hours using 100 ml of methanol as a solvent. The cylindrical filter paper, in which the color toner after the extraction was put, was vacuum-dried at 50° C. for 1 hour. Then, a ratio (%) of a weight, which was subtracted the weight of the dry cylindrical filter paper from a total weight of the previously weighed cylindrical filter paper and the previously weighed color toner, to the weight of the previously weighed color toner was set to an amount (%) of an extracted component with methanol.

(5) Amount of Insoluble Component in Tetrahydrofuran

A color toner for developing electrostatic latent images weighed about 1 g was charged into a Soxhlet extractor equipped with a cylindrical filter (No. 86R, 29×100 mm, manufactured by Toyo Roshi Kaisha, Ltd.) and was refluxed with about 100 ml of tetrahydrofuran (THF) as a solvent for 5 hours. The reflux was carried out at a rate in which one droplet of the solvent was dropped every 5 to 15 minutes. After completion of the reflux, the cylindrical filter was air-dried in a draft for one night and further dried under reduced pressure at 50° C. for 1 hour, and then weighed. Then, an amount of insoluble component in tetrahydrofuran was measured using the following expression.

An amount of insoluble component in tetrahydrofuran(% by weight)=$(S/T)\times 100$.

In the expression, T represents an amount (g) of the color toner for developing electrostatic latent images and S represents an amount (g) of the insoluble component remaining on the filter paper after the reflux.

(6) Amount of Residual Volatile Compound

An amount of residual volatile compounds was obtained using a purge&trap/gas chromatography method (a P&T/GC method) described below.

0.1 g of a color toner for developing electrostatic latent images was charged into a purge container and heated at a heating rate of 10° C./minute from room temperature while passing helium gas as a carrier gas in the container at a flow rate of 50 ml/minutes, and then maintained at 200° C. for 30 minutes. And, a volatilized compound generated by the heating was caught in to a trap tube at −130° C. Then, the caught volatilized compound was determined to obtain an amount of residual volatile compounds.

As the measurement apparatus, a gas chromatograph 6890 (trade name, FID method, manufactured by Agilent Technologies Japan, Ltd.), C-R7A chromatopack (trade name, manufactured by Shimadzu Corporation), a purge&trap sampler of TDC (trade name, manufactured by Agilent Technologies Japan, Ltd.) and a column of DB-5 (trade name, manufactured by J&W, L=30 m, I.D=0.32 mm, Film=0.25 μn) were employed.

Measurement Conditions

A temperature of the column: 50° C. (maintained for 2 minutes) to 270° C. (a heating rate of 10° C./minutes), A sample transfer temperature: 280° C., A detection temperature: 280° C., A carrier gas: helium gas, A flow rate: 1 ml/minutes.

(7) Polymerization Stability

An aqueous dispersion containing colored resin particle after a polymerization reaction dispersed therein was passed to a mesh (20 mesh), and aggregate remaining on the mesh was dried and measured for the weight. The measured weight was set to a weight of the aggregate. Polymerization stability was obtained by an amount of aggregate, which was calculated using the following expression, as an index (note that a total amount of solid after the polymerization in the following expression did not include an amount of dispersion stabilizer). The smaller the amount of aggregate was, the better the polymerization stability was.

An amount of aggregate(%)=(the weight (g) of the aggregate/the total amount of solid after the polymerization)×100.

(8) Minimum Fixing Temperature

A fixing test was conducted using a commercially available non-magnetic-one-component developing type printer (printing speed: 18 sheet/min machine) modified such that the temperature of its fixing roll portion would be variable. The fixing test was performed by varying the temperature of the fixing roll of the modified printer by 5° C. at a time, and measuring the fixing rate of the developer at each temperature to determine a relationship between a temperature and a fixing rate. The fixing rate was calculated from a ratio of an image density after a tape peeling treatment to that before the treatment in a black solid printing area in a test sheet printed by the modified printer. That is, the fixing rate was calculated from the following equation:

$$\text{Fixing rate}(\%)=(ID_{After}/ID_{Before})\times 100$$

where $ID_{Before}$ represents the image density before tape peeling treatment, and $ID_{After}$ represents the image density after tape peeling treatment.

The tape peeling treatment means a series of steps consisting: applying an adhesive tape (Scotch Mending Tape 810-3-18, trade name, manufactured by Sumitomo 3M Limited) to a portion of the test sheet to be evaluated, pressing the adhesive tape at a constant pressure, and then peeling the adhesive tape at a constant speed in a direction along the sheet. The image density was measured by use of a Macbeth's reflection type image density measuring device. The toner fixing temperature denotes the temperature of the fixing roll at which the fixing rate became 80% or more in the fixing test. A toner having a lower fixing temperature is superior because the toner has a low-temperature fixability and thus can be used in a high-printing speed model printer.

(9) Image Density

Copy papers were set in a commercially available non-magnetic-one-component developing type printer (printing speed: 18 sheet/min machine), and the color toner for developing electrostatic latent images was put in a developing device of the printer and was left standing over one day and one night under an (N/N) environment at a temperature of 23° C. and a humidity of 50%. Then, printing was continuously performed at an image density of 5%. And, a solid image was printed every 10 papers printing. Then, an image density of the printed solid image was measured using a Macbeth's reflective image density measuring apparatus. In the same manner, after leaving the color toner for developing electrostatic latent images under a condition of a temperature of 50° C. and a humidity of 80% for 2 weeks, the color toner was put in the developing device under an (N/N) condition and an image density was measured.

(10) Environmental Durability

The printer used in (9) was left standing under each condition of an (N/N) condition of a temperature of 23° C. and a humidity of 50% and a (H/H) condition of a temperature of 35° C. and a humidity of 80% for one day and one night. Printing was continuously performed at an image density of 5%. And, at every 500 papers printing, a solid pattern and a plain pattern were printed.

A printed solid pattern image was measured for an image density in the same way as (9).

And, after the plain pattern printing, the color toner developed a non-image on the photoconductive member after developing was adhered to an adhesive tape (Scotch Mending Tape 810-3-18, trade name, manufactured by Sumitomo 3M Limited). Then, the adhesive tape was stuck on a new sheet of paper to measure a color tone (B) using a spectroscopic color-difference meter ("SE2000", trade name, manufactured by Nippon Denshoku Industries Co., Ltd.). In the same way, an unused adhesive tape was stuck on the same new sheet of paper to measure a color tone (A). Then, the color tones were shown on a L*a*b* space coordinates, and a color difference $\Delta E^*$ was calculated by the two color tones to obtain a fog value. As the fog value is small, fog generated on a printed image is small.

Environmental durability was evaluated by checking a number of the continuously printed paper capable of keeping an image quality of an image density of 1.3 or more and an fog value of 1% or less. Final number of the paper was set to 10,000. The samples having 10,000 or more in a table show that the aforesaid image quality is kept even after 10,000 papers printing.

Example 1

83 parts of styrene, 17 parts of N-butylacrylate, 6 parts of C.I. Pigment Yellow 74 ("Fast Yellow 7415", trade name, manufactured by SANYO COLOR WORKS, LTD.), 0.8 parts of divinylbenzene and 0.25 parts of polymethacrylate ester macromonomer ("AA6", trade name, manufactured by Toagosei CO., LTD.) were mixed and dispersed using a media type dispersion apparatus ("PICO MILL", trade name, manufactured by ASADA IRON WORKS. CO., LTD.) to prepare a dispersion of colorant. To the prepared dispersion of colorant, 2 parts of positive charge control resin (styrene.n-butylacrylate.N,N-diethyl-N-methyl-2-(methacryloyloxy) ethyl aluminum p-toluenesulfonic acid copolymer, a weight average molecular weight:18,000, a glass transition temperature: 60° C., an amount of functional group: 2%, manufactured by FUJIKURA KASEI CO., LTD.), 0.8 parts of 2,2,4,6,6-pentamethylheptane-4-thiol and 10 parts of dipentaerythritol hexamyristate (a hydroxy value: 1.5 mgKOH/g) were dispersed at room temperature using a bead mil to prepare a polymerizable monomer composition for core.

Separately, an aqueous solution containing 5.5 parts of sodium hydroxide dissolved in 50 parts of ion-exchanged water was gradually added to an aqueous solution containing 9.8 parts of magnesium chloride dissolved in 250 parts of ion-exchanged water, with stirring, to prepare a colloidal dispersion of magnesium hydroxide.

And, 1 parts of methyl methacrylate and 65 parts of water were mixed to prepare an aqueous dispersion of polymerizable monomer for shell.

The polymerizable monomer compound for core obtained above was added to the colloidal dispersion of magnesium hydroxide obtained above, and the mixture was stirred until droplets stabilized. After the droplets stabilized, 3 parts of dimethyl 2,2'-azobis (2-methylpropionate) ("V601", trade name, manufactured by Wako Pure Chemical Industries, Ltd.) was added to the mixture, and then the mixture was stirred at 15,000 rpm under shearing force using an Ebara Milder ("MDN303V", trade name, manufactured by Ebara Corporation) for 30 minutes to form smaller fine droplets of the polymerizable monomer composition for core.

The colloidal dispersion of magnesium hydroxide in which the droplets of the polymerizable monomer composition for core were dispersed was charged into a reactor equipped with an agitating blade, and heated to 85° C. to initiate a polymerization reaction. At the time when the conversion of the monomer into a polymer reached almost 100%, the aqueous dispersion of the polymerizable monomer for shell and 0.3 parts of 2,2'-azobis-(2-methyl-N(2-hydroxyethyl)propionamide) ("VA-086", trade name, manufactured by Wako Pure Chemical Industries, Ltd.), as a water-soluble polymerization initiator, dissolved in 20 parts of ion-exchanged water were charged into the reactor. After the polymerization reaction was continued for 4 hours, the polymerization reaction was stopped and the dispersion was cooled to obtain an aqueous dispersion of colored resin particles.

Then, while maintaining the temperature at 85° C., nitrogen gas was injected into the reactor through a pipe mounted at the lower part of the reactor to replace vapor phase existing in the upper of the reactor with the nitrogen gas. And, under stirring with the agitating blade, nitrogen gas was injected into the reactor at a rate of 0.08 $m^3$/hr·Kg to be subjected to a stripping treatment for 10 hours for removing residual volatile compounds. Then, the aqueous dispersion of core-shell type colored resin particle was cooled at room temperature.

While stirring the aqueous dispersion of colored resin particles thus prepared at a room temperature, the pH of the system was adjusted to 5 or lower using sulfuric acid to be subjected to acid washing (25° C., 10 minutes). After the aqueous dispersion was filtered to separate water, 500 parts of ion-exchanged water was newly added thereto to form a slurry again to subject to water washing. Thereafter, the dehydration and water washing were repeatedly performed several times at room temperature, and solids was separated by filtration from the solution and dried at 40° C. for two days and two nights using a dryer to prepare dried colored resin particles. The colored resin particles thus obtained had a volume average particle diameter (Dv) of 9.1 μm, a particle diameter distribution (Dv/Dp) of 1.23 and an average circularity of 0.973.

To 100 parts of the colored resin particles obtained above, 1 part of silica having a degree of hydrophobic property of 65% and a volume average particle diameter of 12 nm and 1 part of silica having a volume average particle diameter of 40 nm were added and mixed for 10 minutes at 1,400 rpm using HENSCHEL MIXER to prepare color toner for developing electrostatic latent images. Property of the color toner and image quality of a printed image developed using the color toner were evaluated according to the above-mentioned manner. The results were shown in table 1.

Example 2

In same way as the preparation of Example 1, except that C.I. Pigment Yellow 74 was exchanged for 6 parts of a solid dispersion pigment (manufactured by Fuji Pigment Co., Ltd.) of C.I. Pigment Red 150 and C.I. Pigment Red 31, color toner for developing electrostatic latent images was obtained. Property of the color toner for developing electrostatic latent images and image quality of a printed image developed using the color toner were evaluated as with Example 1. The results were shown in table 1.

Example 3

In the same way as the preparation of Example 1, except that C.I. Pigment Yellow 74 was exchanged for 6 parts of cyan colorant produced such that C.I. Pigment Blue 15:3 ("BX121", trade name, manufactured by Dainippon Ink And Chemicals, Incorporated) was dispersed into a hot water, boiled for 20 minutes and rewashed, color toner for developing electrostatic latent images was obtained. Property of the color toner for developing electrostatic latent images and image quality of a printed image developed using the color toner were evaluated as with Example 1. The results were shown in table 1.

Comparative Example 1

To 100 parts of positive charge control resin (a weight average molecular weight: 12000, a glass transition temperature: 67° C.) produced by mixing 83 parts of styrene, 15 parts of N-butylacrylate and 2 parts of N-diethyl-N-methyl-2-(methacryloyloxy) ethyl ammonium P-toluenesulfonic acid, 24 parts of toluene and 6 parts of methyl ethyl ketone were dispersed, and then the mixture was stirred by rolls under cooling. After the positive charge control resin was winded on the roll, 100 parts of C.I. Pigment Yellow 74 ("SEIKAFAST YELLOW 2017E", trade name, manufactured by Dainichiseika Color & Chemicals Mfg. Co., Ltd.) and 40 parts of hydrophobicitizing-treated silica particles ("RX-50", trade name, manufactured by Nippon Aerosil co., ltd.) having a primary particle diameter of 40 nm were gradually added and kneaded for 40 minutes to prepare a positive charge control resin composition. During this period, the clearance between the rolls was initially 1 mm, broadened gradually, to finally to 3 mm, and an organic solvent (a solvent mixture of methyl ethyl ketone/methanol=4/1) was added occasionally according to mixing and kneading condition of the charge control resin composition. After the mixing, the used organic solvent was removed under reduced pressure.

Separately, an aqueous solution containing 6.9 parts of sodium hydroxide dissolved in 50 parts of ion-exchanged water was gradually added to an aqueous solution containing 9.8 parts of magnesium chloride dissolved in 250 parts of ion-exchanged water, with stirring, to prepare a colloidal dispersion of magnesium hydroxide.

A monovinyl monomer comprising 90 parts of styrene and 10 parts of n-butyl acrylate, 14.4 parts of the obtained positive charge control compound, 3 parts of t-dodecyl mercaptan and 10 parts of pentaerythritol tetrastearate were stirred and mixed to be dispersed uniformly to prepare a polymerizable monomer composition for core.

And, 2 parts of methyl methacrylate and 100 parts of water were mixed to prepare an aqueous dispersion of polymerizable monomer for shell.

The polymerizable monomer composition for core obtained above was added to the colloidal dispersion of magnesium hydroxide obtained above, and the mixture was stirred until droplets stabilized. After the droplets stabilized, 6 parts of t-butylperoxy-2-ethylhexanoate ("PERBUTYL O", trade name, manufactured by NOF CORPORATION) was added to the mixture, and then the mixture was stirred at 15,000 rpm under shearing force using an Ebara Milder ("MDN303V", trade name, manufactured by Ebara Corporation) for 30 minutes to form smaller fine droplets of the polymerizable monomer mixture for core.

The colloidal dispersion of magnesium hydroxide in which the droplets of the polymerizable monomer composition for core were dispersed was charged into a reactor equipped with an agitating blade, and then heated. At the time when the conversion of the monomer into a polymer reached almost 100%, the aqueous dispersion of the polymerizable monomer for shell and 0.2 parts of 2,2'-azobis-(2-methyl-N-(2-hydroxyethyl)-propionamide) ("VA-086", trade name, manufactured by Wako Pure Chemical Industries, Ltd.,), as a soluble initiator, dissolved in 65 parts of ion-exchanged water were charged into the reactor. After the polymerization reaction was further continued for 8 hours, the reaction was stopped to obtain an aqueous dispersion of core-shell type colored resin particles having a pH value of 9.5.

While stirring the aqueous dispersion of colored resin particles thus prepared, the pH of the system was adjusted to 5 using sulfuric acid to be subjected to acid washing (25° C., 10 minutes). After the aqueous dispersion was filtered to separate water, 500 parts of ion-exchanged water was newly added thereto to form a slurry again to subject to water washing. Thereafter, the dehydration and water washing were repeatedly performed several times at a room temperature, and solids was separated by filtration from the solution and dried at 45° C. for two days and two nights using a dryer to prepare dried colored resin particles. The colored resin particles thus obtained had a volume average particle diameter (Dv) of 9.1 μm, a particle diameter distribution (Dv/Dp) of 1.23 and an average circularity of 0.973.

To 100 parts of the colored resin particles obtained above, 1 part of silica having a degree of hydrophobic property of 65% and a volume average particle diameter of 12 nm and 2 parts of silica having a volume average particle diameter of 40 nm were added and mixed for 10 minutes at 1,400 rpm using HENSCHEL MIXER to prepare color toner for developing electrostatic latent images. Property of the color toner for developing electrostatic latent images and image quality of a printed image developed using the color toner were evaluated as with Example 1. The results were shown in table 2.

Comparative Production Example 2

In the same way as the preparation of Comparative Production Example 1 except that C.I. Pigment Yellow 74 was exchanged for C.I. Pigment Red 57:1 ("carmine 6B", trade name, manufactured by SANYO COLOR WORKS, LTD.), color toner for developing electrostatic latent images was obtained. Property of the color toner for developing electrostatic latent images and image quality of a printed image developed using the color toner were evaluated as with Example 1. The results were shown in table 2.

Comparative Example 3

In the same way as the preparation of Comparative Production Example 1 except that C.I. Pigment Yellow 74 was exchanged for C.I. Pigment Blue 15:3 ("B-120", trade name, manufactured by SANYO COLOR WORKS, LTD.), color toner for developing electrostatic latent images was obtained. Property of the color toner for developing electrostatic images and image quality of a printed image developed using the color toner were evaluated as with Example 1. The results were shown in table 2.

TABLE 1

| | Ex. 1 | Ex. 2 | Ex. 3 |
|---|---|---|---|
| <Property of Colored Resin Particle> | | | |
| Volume average particle diameter (μm) | 9.1 | 9.3 | 9.2 |
| Particle diameter distribution (Dv/Dp) | 1.23 | 1.22 | 1.26 |
| Average circularity | 0.973 | 0.978 | 0.967 |
| Amount of extracted component with methanol (wt %) | 3.3 | 3.6 | 3.1 |
| Amount of insoluble component in THF (ppm) | 65 | 61 | 60 |
| Amount of residual volatile compound (ppm) | 90 | 110 | 120 |
| <Colorant> | | | |
| pH of extracted liquid with hot water | 7.0 | 7.3 | 7.0 |
| Conductivity of extracted liquid with hot water (μs/cm) | 98 | 77 | 17 |
| Polymerization stability | 0.2 | 0.1 | 0.1 |
| <Evaluation of Printed Image> | | | |
| Minimum fixing temperature (° C.) | 140 | 140 | 140 |
| Image Density | | | |
| Starting | 1.42 | 1.40 | 1.38 |
| After 2 weeks | 1.27 | 1.30 | 1.27 |
| Environmental Durability | | | |
| N/N | 10,000 or more | 10,000 or more | 10,000 or more |
| H/H | 10,000 or more | 10,000 or more | 10,000 or more |

TABLE 2

Table 1

| | Com. Ex. 1 | Com. Ex. 2 | Com. Ex. 3 |
|---|---|---|---|
| <Property of Colored Resin Particle> | | | |
| Volume average particle diameter (μm) | 9.1 | 9.5 | 9.3 |
| Particle diameter distribution (Dv/Dp) | 1.20 | 1.24 | 1.21 |
| Average circularity | 0.973 | 0.965 | 0.962 |
| Amount of extracted component with methanol (wt %) | 6.8 | 6.4 | 6.2 |
| Amount of insoluble component in THF (ppm) | 68 | 71 | 70 |
| Amount of residual volatile compound (ppm) | 300 | 450 | 380 |
| <Colorant> | | | |
| pH of extracted liquid with hot water | 8.9 | 8.4 | 5.8 |
| Conductivity of extracted liquid with hot water (μs/cm) | 40 | 24 | 38 |
| Polymerization stability | 8.0 | 10.1 | 5.2 |
| <Evaluation of Printed Image> | | | |
| Minimum fixing temperature (° C.) | 150 | 150 | 145 |
| Image Density | | | |
| Starting | 1.32 | 1.40 | 1.18 |
| After 2 weeks | 0.95 | 1.15 | 1.00 |
| Environmental Durability | | | |
| N/N | 8,500 | 8,500 | 9,000 |
| H/H | 5,000 | 5,500 | 6,000 |

The results of the evaluation of the toners for developing electrostatic latent images shown in the tables 1 and 2 show the following facts.

The color toners for developing electrostatic latent images of the Comparative Example 1 to 3, in which a pH value of extracted liquid with water by means of a hot water extraction method from the colorant and an amount of extracted liquid with methanol were outside of the scope of the present invention, form an image with a low image density especially when the toners are left under a condition of a temperature of 50° C. and a humidity of 80%, showing insufficient environmental durability.

On the contrary, the color toners for developing electrostatic latent images of the Examples 1 to 3 according to the present invention form an image with a high image density, showing good environmental durability.

What is claimed is:

1. A color toner for developing electrostatic latent images comprising a colored resin particle containing at least a binder resin, a colorant, a charge control agent and a parting agent, wherein said colorant is a yellow colorant, a magenta colorant or a cyan colorant, wherein an extracted liquid with water by means of a hot water extraction method from said colorant has a pH value in the range from 6.0 to 8.0, wherein said colored resin particle has a volume average particle diameter (Dv) in the range from 4 to 10 μm and an average circularity in the range from 0.93 to 0.995, wherein an amount of extracted components with methanol is 7% by weight or less, and wherein an amount of residual volatile compounds is 500 ppm or less.

2. The color toner for developing electrostatic latent images according to claim 1, wherein an amount of insoluble component in tetrahydrofuran is in the range from 30 to 95% by weight.

3. The color toner for developing electrostatic latent images according to claim 1, wherein the colorant is C. I. Pigment Yellow 74.

4. The color toner for developing electrostatic latent images according to claim 3, wherein an electrical conductivity of an extracted liquid with water by means of a hot water extraction method from the colorant is in the range from 10 to 130 μS/cm.

5. The color toner for developing electrostatic latent images according to claim 1, wherein the colorant is a mixture of C. I. Pigment Red 31 and C. I. Pigment Red 150.

6. The color toner for developing electrostatic latent images according to claim 5, wherein an electrical conductivity of an extracted liquid with water by means of a hot water extraction method from the colorant is in the range from 10 to 100 μS/cm.

7. The color toner for developing electrostatic latent images according to claim 1, wherein the colorant is C. I. Pigment Blue 15:3 or C. I. Pigment Blue 15:4.

8. The color toner for developing electrostatic latent images according to claim 7, wherein an electrical conductivity of an extracted liquid with water by means of a hot water extraction method from the colorant is in the range from 10 to 40 μS/cm.

9. The color toner for developing electrostatic latent images according to claim 1, wherein the parting agent is a multifunctional ester compound.

10. The color toner for developing electrostatic latent images according to claim 1, wherein a product (a×b) of "a" showing a hydroxy value (mgKOH/g) of the parting agent and "b" showing an addition amount of the parting agent per 100 parts by weight of the binder resin is in the range from 0.5 to 40.

11. The color toner for developing electrostatic latent images according to claim 1, wherein the charge control agent comprises a charge control resin.

* * * * *